US008404331B2

(12) United States Patent
Kawakami et al.

(10) Patent No.: US 8,404,331 B2
(45) Date of Patent: Mar. 26, 2013

(54) BUILDING MATERIAL AND METHOD FOR MANUFACTURING THEREOF

(75) Inventors: Makoto Kawakami, Ichinomiya (JP); Koji Sawada, Anjo (JP); Yoshinori Hibino, Ama-gun (JP)

(73) Assignee: Nichiha Corporation, Nagoya-Shi (JP)

( * ) Notice: Subject to any disclaimer, the term of this patent is extended or adjusted under 35 U.S.C. 154(b) by 673 days.

(21) Appl. No.: 12/475,086

(22) Filed: May 29, 2009

(65) Prior Publication Data

US 2009/0297789 A1 Dec. 3, 2009

(30) Foreign Application Priority Data

May 30, 2008 (JP) ..... 2008-141803
May 30, 2008 (JP) ..... 2008-141809

(51) Int. Cl.
*B05D 3/06* (2006.01)

(52) U.S. Cl. ..... 428/192; 428/195.1; 428/201; 428/332; 52/311.1

(58) Field of Classification Search ..... 428/192, 428/195.1, 201, 332; 427/555; 52/311.1
See application file for complete search history.

(56) References Cited

U.S. PATENT DOCUMENTS 2,021,578 A * 11/1935 Odell ..... 52/314
2003/0200711 A1* 10/2003 Peterson et al. ..... 52/268
2009/0068370 A1* 3/2009 Mizuno et al. ..... 427/420

FOREIGN PATENT DOCUMENTS

JP 2003-343024 A 12/2003

* cited by examiner

*Primary Examiner* — Gerard Higgins
*Assistant Examiner* — Christopher Polley
(74) *Attorney, Agent, or Firm* — Birch, Stewart, Kolasch & Birch, LLP

(57) ABSTRACT

The present invention provides a building material in which a coating is applied to a front surface and a side surface is sufficiently adhered to a sealing and method for manufacturing thereof. In a building material in which a coating is applied to a front surface, a coating film on a side surface is removed or reduced by laser irradiation. The part of the side surface in which the coating film has been removed or reduced by laser irradiation has a width of at least 5 mm from a front surface side toward a rear surface side of the building material, or extends over the entire side surface from the front surface side toward the rear surface side of the building material, or is formed more than a part in which coating film is formed.

7 Claims, 9 Drawing Sheets

BUILDING MATERIAL AND METHOD FOR MANUFACTURING THEREOF

BACKGROUND OF THE INVENTION

1. Field of the Invention

The present invention relates to a building material and method for manufacturing thereof, and more particularly to a building material in which a coating is applied to a front surface and a side surface exhibits a favorable adhesion property in relation to a sealing and method for manufacturing thereof.

2. Description of the Related Art

In a typical building material, front surface and rear surface of a base material are often coated to suppress variation in the physical properties of the building material due to water absorption, to improve weatherability, and to enhance the outer appearance.

Then, a plurality of the coated building materials is installed onto an outer wall or an inner wall of a house or the like to form a wall surface. At this time, spaces are often provided between vertically and/or horizontally adjacent building materials at constant intervals using a joiner, a backup material, or the like, and a waterproof, flexible rubber elastic sealing constituted by a polymer such as silicone, modified silicone, polyurethane, or polysulfide is charged into the spaces to join the adjacent building materials. The dimensions of building boards vary over time, and by charging a sealing in this manner, temporal variation in the building boards can be dealt with (see Japanese Unexamined Patent Application Publication No. 2003-343024).

However, when a coating film is formed on the side surface of the building material, the sealing that is adhered to the coating film may peel away when the coating film peels away from the side surface.

When the sealing peels away from the building material, a gap forms between the building material and the sealing, and rainwater infiltrates the gap. The infiltrating rainwater is absorbed through the side surface of the building material, causing the physical properties of the building material to deteriorate, and when the rainwater spreads over the rear surface side of the building material, members other than the building material are adversely affected thereby.

To make the sealing less likely to peel away from the building material, a coating film need not be formed on the side surface of the building material. However, when the front surface of the building material is coated, the coat applied to the front surface often spreads to the side surface such that an unwanted coating film is formed on the side surface.

When the front surface of the building material is coated using a coating method such as spraying or flow coating, the side surface is particularly likely to be coated in the coat, leading to the formation of an unwanted coating film.

SUMMARY OF THE INVENTION

The present invention has been designed in consideration of the current circumstances, and it is an object thereof to provide a building material in which a coating is applied to a front surface and a side surface is sufficiently adhered to a sealing and method for manufacturing thereof.

To achieve this object, an invention described in claim 1 is a building material in which a coating is applied to a front surface, wherein a side surface includes a part in which a coating film has been removed or reduced by laser irradiation. Note that in the present invention, the side surface denotes a part that does not include a shiplap portion of the building material, opposes an adjacent building material following installing, and to which a sealing is adhered.

The building material of the present invention can be produced by disposing the building material on a building material conveyance line such that laser irradiation can be performed on the side surface of the conveyed building material alone and then subjecting the side surface of the conveyed building material to laser irradiation to remove or reduce a coating film formed on the side surface while the building material is conveyed. An output value of the laser differs according to the condition of the coating film and the material of the building material, but is typically between 1.8 and 30 watts. When the output value of the laser is smaller than 1.8 watts, the coating film formed on the side surface of the building material cannot be removed or reduced sufficiently. On the other hand, even when the output value is increased beyond 30 watts, remarkable effect is not provided more than thereof.

According to the present invention, the coating film formed on only the side surface of the building material is removed or reduced by subjecting laser irradiation, and therefore the design characteristic of the front surface is not damaged and the sealing is less likely to peel away during installing.

An invention described in claim 2 is the building material according to claim 1, wherein the part of the side surface of the building material in which the coating film has been removed or reduced by laser irradiation has a width of at least 5 mm from a front surface side toward a rear surface side of the building material.

The thickness of a building material is typically 10 mm or more, while the height of a joiner, a backup material, or the like that is installed to provide constant spaces between adjacent building materials is 3 mm or more. Hence, depending on the laser irradiation range of the side surface, a non-laser-irradiated coating film part that contacts the sealing may remain on the side surface. However, in the laser-irradiated part, the coating film is removed or reduced, and therefore, as long as the laser-irradiated part of the side surface has a width of 5 mm or more from the front surface side toward the rear surface side of the building material, the sealing adhered to the laser-irradiated part is less likely to peel away. Thus, sufficient overall adhesiveness is obtained, and the sealing is unlikely to peel away from the building material even after installing. When the laser-irradiated part has a width of less than 5 mm from the front surface side toward the rear surface side of the building material, variation occurs in the charging precision of the sealing at the installing site, and the overall adhesiveness of the sealing becomes insufficient. As a result, the sealing may peel away from the building material.

In the present invention, the laser-irradiated part of the side surface of the building material has a minimum required width of at least 5 mm from the front surface side toward the rear surface side of the building material, and therefore the sealing is unlikely to peel away during installing. Moreover, variable costs can be suppressed and favorable productivity can be achieved.

An invention described in claim 3 is the building material according to claim 1, wherein the building material has design patent of convexoconcave on the front surface, and the part of the side surface of the building material in which coating film has been removed or reduced by laser irradiation has a width from an apex of a convex portion of the building material to a lowest side of a concave portion and a width of at least 5 mm from the lowest side of the concave portion toward a rear surface side.

According to the present invention, the sealing is unlikely to peel away during installing even in a building material having design patent of convexoconcave on its front surface, and since the laser-irradiated part of the side surface of the building material has the required minimum width containing a width from the apex of the convex portion of the building material to the lowest side of the concave portion and a width of at least 5 mm from the lowest side of the concave portion toward the rear surface side, variable costs can be suppressed and favorable productivity can be achieved.

An invention described in claim 4 is the building material according to claim 1, wherein the part of the side surface of the building material in which the coating film has been removed or reduced by laser irradiation extends over the entire surface of the side surface from a front surface side to a rear surface side of the building material.

In the present invention, the coating film is removed or reduced by performing laser irradiation on the entire side surface of the building material, from the front surface side to the rear surface side, and therefore the sealing is extremely unlikely to peel away.

An invention described in claim 5 is the building material according to claim 1, wherein the building material has design patent of convexoconcave on the front surface, and the part of the side surface of the building material in which the coating film has been removed or reduced by laser irradiation extends over the entire surface of the side surface from a front surface side to a rear surface side of the building material.

In the present invention, the coating film of the building material having design patent of convexoconcave on its front surface is removed or reduced by subjecting the entire side surface of the building material to laser irradiation from the front surface side to the rear surface side, and therefore, even in a building material having design patent of convexoconcave on its front surface, the sealing is extremely unlikely to peel away.

An invention described in claim 6 is the building material according to claim 1, wherein the side surface of the building material includes the part in which coating film has been removed or reduced by laser irradiation and a part in which coating film is formed, and the part in which coating film has been removed or reduced by laser irradiation is more than the part in which coating film is formed.

In the side surface of the building material, sealing adhered to the part in which coating film has been removed or reduced by laser irradiation is less likely to peel away, and the part in which coating film has been removed or reduced by laser irradiation is more than the part in which coating film is formed. Thus, sufficient overall adhesiveness is obtained, and the sealing is unlikely to peel away from the building material even after installing. When the laser-irradiated part is less than the coating part, the overall adhesiveness of the sealing becomes insufficient. As a result, the sealing may peel away from the building material.

In the present invention, the laser-irradiated part of the side surface of the building material has a minimum required width, and therefore the sealing is unlikely to peel away during installing. Moreover, variable costs can be suppressed and favorable productivity can be achieved.

An invention described in claim 7 is the building material according to claim 1, wherein said building material has design patent of convexoconcave on the front surface, and the side surface of the building material includes the part in which coating film has been removed or reduced by laser irradiation and a part in which coating film is formed, and the part in which coating film has been removed or reduced by laser irradiation is more than the part in which coating film is formed.

In the present invention, the sealing is unlikely to peel away during installing even in a building material having design patent of convexoconcave on its front surface, and since the laser-irradiated part of the side surface of the building material has the required minimum width, variable costs can be suppressed and favorable productivity can be achieved.

An invention described in claim 8 is a method for manufacturing a building board, comprising step of: applying a coating to a front surface of the building board, and removing or reducing coating film which is formed on a side surface of the building board by laser irradiation. Note that in the present invention, the side surface denotes a part that does not include a shiplap portion of the building material, opposes an adjacent building material following installing, and to which a sealing is adhered.

The method of the present invention can be produced by disposing the building material on a building material conveyance line such that laser irradiation can be performed on the side surface of the conveyed building material alone and then subjecting the side surface of the conveyed building material to laser irradiation to remove or reduce a coating film formed on the side surface while the building material is conveyed. An output value of the laser differs according to the condition of the coating film and the material of the building material, but is typically between 1.8 and 30 watts. When the output value of the laser is smaller than 1.8 watts, the coating film formed on the side surface of the building material cannot be removed or reduced sufficiently. On the other hand, even when the output value is increased beyond 30 watts, remarkable effect is not provided more than thereof.

According to the present invention, the coating film formed on only the side surface of the building material is removed or reduced by subjecting laser irradiation, and therefore the design characteristic of the front surface is not damaged and the sealing is less likely to peel away during installing.

An invention described in claim 9 is the method for manufacturing a building board according to claim 8, wherein removing or reducing coating film on the side surface of the building board by laser irradiation is applied to a width of at least 5 mm from a front surface side toward a rear surface side of the building material.

In the present invention, the laser-irradiated part of the side surface of the building material has a minimum required width of at least 5 mm from the front surface side toward the rear surface side of the building material, and therefore the sealing is unlikely to peel away during installing. Moreover, variable costs can be suppressed and favorable productivity can be achieved.

An invention described in claim 10 is the method for manufacturing a building board according to claim 8, wherein said building material has design patent of convexoconcave on the front surface, and removing or reducing coating film on the side surface of the building board by laser irradiation is applied to a width from an apex of a convex portion of the building material to a lowest side of a concave portion and a width of at least 5 mm from the lowest side of the concave portion toward a rear surface side.

According to the present invention, the sealing is unlikely to peel away during installing even in a building material having design patent of convexoconcave on its front surface, and since the laser-irradiated part of the side surface of the building material has the required minimum width containing a width from the apex of the convex portion of the building material to the lowest side of the concave portion and a width of at least 5 mm from the lowest side of the concave portion toward the rear surface side, variable costs can be suppressed and favorable productivity can be achieved.

An invention described in claim 11 is the method for manufacturing a building board according to claim 8, wherein removing or reducing coating film on the side surface of the building board by laser irradiation is applied to an entire surface of the side surface from a front surface side to a rear surface side of the building material.

In the present invention, the coating film is removed or reduced by performing laser irradiation on the entire side surface of the building material, from the front surface side to the rear surface side, and therefore the sealing is extremely unlikely to peel away.

An invention described in claim 12 is the method for manufacturing a building board according to claim 8, wherein said building material has design patent of convexoconcave on the front surface, and wherein removing or reducing coating film on the side surface of the building board by laser irradiation is applied to an entire surface of the side surface from a front surface side to a rear surface side of the building material.

In the present invention, the coating film of the building material having design patent of convexoconcave on its front surface is removed or reduced by subjecting the entire side surface of the building material to laser irradiation from the front surface side to the rear surface side, and therefore, even in a building material having design patent of convexoconcave on its front surface, the sealing is extremely unlikely to peel away.

An invention described in claim 13 is the method for manufacturing a building board according to claim 8, wherein removing or reducing coating film on the side surface of the building board by laser irradiation is applied so that the side surface of the building material includes the part in which coating film is removed or reduced by laser irradiation and a part in which coating film is formed, and the part in which coating film has been removed or reduced by laser irradiation is more than the part in which coating film is formed.

In the present invention, the laser-irradiated part of the side surface of the building material has a minimum required width, and therefore the sealing is unlikely to peel away during installing. Moreover, variable costs can be suppressed and favorable productivity can be achieved.

An invention described in claim 14 is the method for manufacturing a building board according to claim 8, wherein said building material has design patent of convexoconcave on the front surface, and removing or reducing coating film on the side surface of the building board by laser irradiation is applied so that the side surface of the building material includes the part in which coating film is removed or reduced by laser irradiation and a part in which coating film is formed, and the part in which coating film has been removed or reduced by laser irradiation is more than the part in which coating film is formed.

In the present invention, the sealing is unlikely to peel away during installing even in a building material having design patent of convexoconcave on its front surface, and since the laser-irradiated part of the side surface of the building material has the required minimum width, variable costs can be suppressed and favorable productivity can be achieved.

According to the present invention, only the coating film formed on the side surface of the building material is removed or reduced by the laser, and therefore a building material in which the design characteristic of the front surface is not damaged and the sealing is unlikely to peel away during installing can be provided. Further, a building material having design patent of convexoconcave on its front surface, in which the sealing is unlikely to peel away during installing, can be provided.

DESCRIPTION OF THE PREFERRED EMBODIMENTS

Figure 1:
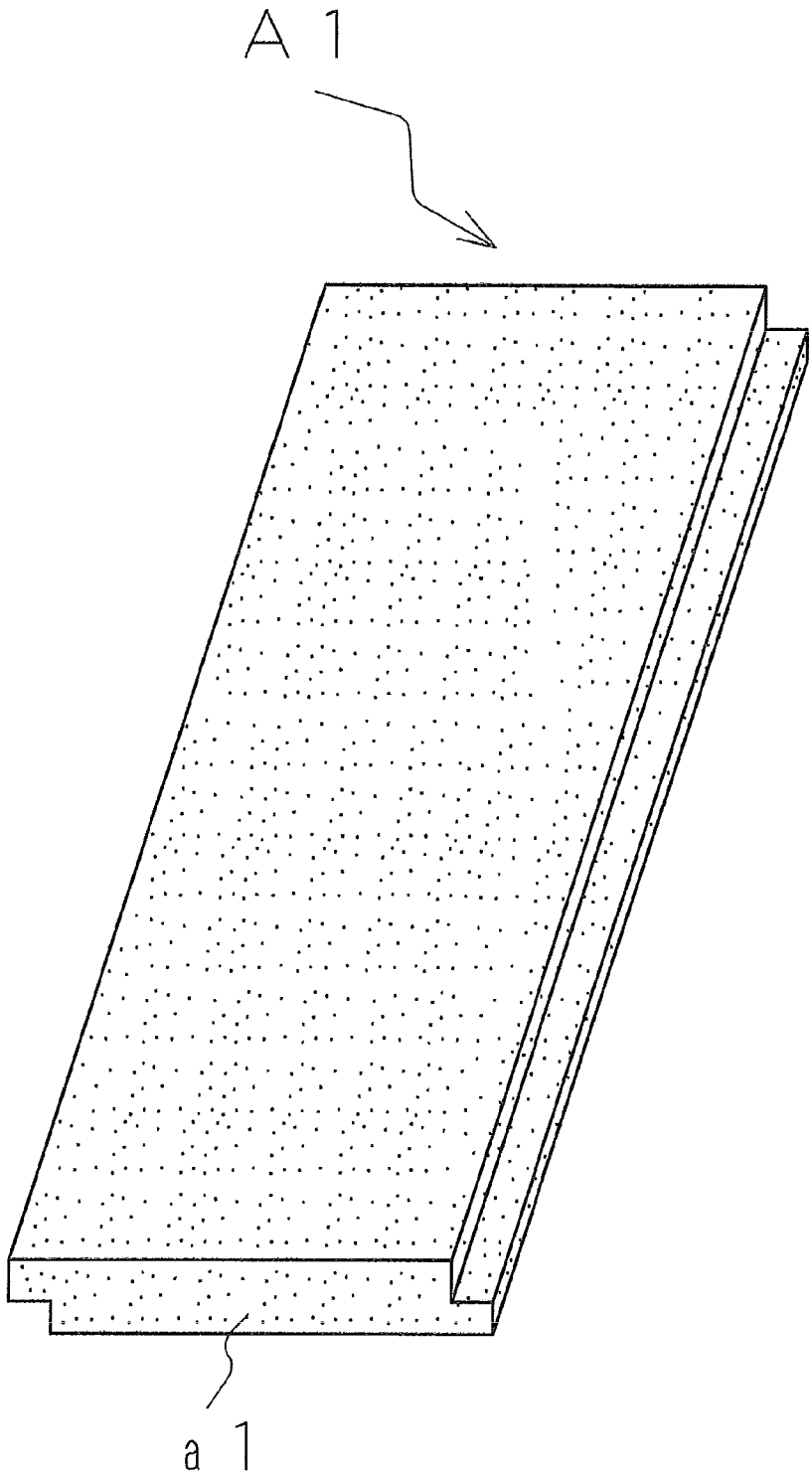
FIG. 1 is a view showing an example of a building board having a smooth front surface.

First, the effects of laser irradiation were evaluated using test pieces in which a coating film was formed on a side surface.

Four test pieces made by siding board in which silicone acrylic emulsion coat was applied up to a side surface were prepared, and the adhesiveness of one test piece serving as a blank was evaluated without performing laser irradiation on the side surface. In the remaining test pieces, a coating film was removed by subjecting the entirety of the respective side surfaces of the test pieces to laser irradiation from a front surface side to a rear surface side at outputs of 18 watts, 24 watts, and 30 watts, respectively, using a carbon dioxide gas laser manufactured by Keyence Corporation. The adhesiveness of the respective obtained samples was then evaluated. Note that even with an 18-watt laser output, substantially all of the coating film was removed, and when the output was raised to 24 watts and 30 watts, the coating film was removed even more completely. To evaluate the adhesiveness, an adhesive tape was adhered to the entire side surface of the obtained sample and then peeled away, whereupon the amount of deposits such as the coating film that was peeled away (adhered to the adhesive tape side) was measured. In other words, an increase in the deposits amount that is peeled away (adhered to the adhesive tape side) indicates a weaker adhesive force, thereby indicating that an adhered sealing may also peel away.

On the blank (the non-laser-irradiated sample), it was observed that a large amount of the coating film peeled away onto the adhesive tape side. In other words, although a coating film was formed on the side surface of the blank, the adhesiveness of the coating film was weak, indicating that if a sealing were to be applied during installing, the sealing would likely peel away together with the coating film.

In the laser-irradiated samples, on the other hand, substantially all of the coating film was removed from all of the samples, and therefore substantially no deposits were observed on the adhesive tape side.

Hence, substantially all of the coating film is removed from a building material having a laser-irradiated side surface, and therefore, when a sealing is adhered, the sealing is not likely to peel away.

Another test was performed to evaluate the adhesiveness of a sealing when laser irradiation is performed on the coating film on the side surface.

First, four test pieces made by siding board (width 50 mm×thickness 16 mm×length 50 mm) in which silicone acrylic emulsion coat was applied up to a side surface were prepared. Two test pieces were left as blanks, i.e. laser irradiation was not performed on the side surface, whereas in the other two, the coating film was removed by performing laser irradiation on the entire side surface from the front surface side to the rear surface side at an output of 24 watts using a carbon dioxide gas laser manufactured by Keyence Corporation, thereby forming test pieces having a laser-irradiated side surface. A primer comprised of a urethane-based resin as a principle component was then applied to the side surface of each test piece, whereupon the two laser-irradiated test pieces were disposed such that the respective side surfaces thereof faced each other at an interval of 10 mm. A sealing comprised of single fluid component-type modified silicone was then charged between the test pieces at a width of 10 mm, a depth of 7 mm, and a length of 50 mm, cured for two days at 28° C., cured for one day at 50° C. 95% RH, cured for a further 10 hours at 80° C., and then submerged in water for fourteen days. Thus, a sample in which a sealing is charged between two test pieces having laser-irradiated side surfaces was prepared. Similar processing was performed on the blank test pieces to prepare a sample in which a sealing is charged between two test pieces having non-laser-irradiated side surfaces. The test pieces adhered via the sealing in the respective samples obtained in this manner were then pulled outward at room temperature and at a speed of 50 mm/min to measure the strength required to peel the sealing away from the test piece, and this strength, or in other words tensile strength, was set as an index of the adhesiveness of the sealing. More specifically, as the value of the tensile strength increases, steadily greater strength is required to peel the sealing away from the test piece, indicating that the sealing is less likely to peel away from the test piece.

The tensile strength of the sample using the blank test pieces (the sample in which the sealing was charged between the two test pieces having the non-laser-irradiated side surfaces) was 15 N/cm$^2$. When the peeled sealing was observed, it was found that the coating film of the side surface was adhered to the peeled surface of the sealing, and thereby concluded that peeling of the sealing accompanies peeling of the coating film on the side surface.

On the other hand, the tensile strength of the sample in which the sealing was charged between the two test pieces having the laser-irradiated side surfaces was 48 N/cm$^2$, i.e. an extremely high value in comparison with the sample using the blank test pieces. Further, when the peeled sealing was observed, it was found that substantially no coating film was adhered to the peeled surface of the sealing. The reason for this finding is that substantially all of the coating film was removed from the side surface by the laser irradiation.

Hence, when the side surface of the building material is subjected to laser irradiation, substantially all of the coating film is removed, and therefore, even when the sealing is adhered, the sealing is not likely to peel away.

Next, specific embodiments of the present invention will be described in accordance with FIGS. 1 to 9.

First Embodiment

FIG. 1 is a view showing an example of a building board having a smooth front surface. A building board A1 has a coated front surface and a side surface not having a shiplap portion, in which the front surface is coated in a process for applying coat to the front surface using spray, a flow coater, a roll coater, or similar. The coat spreads over the side surface to form a coated part a1. Although not shown in the drawing, a far-side side surface also does not include a shiplap portion and the coat spreads over this side surface also to form the coated part a1.

Figure 2:
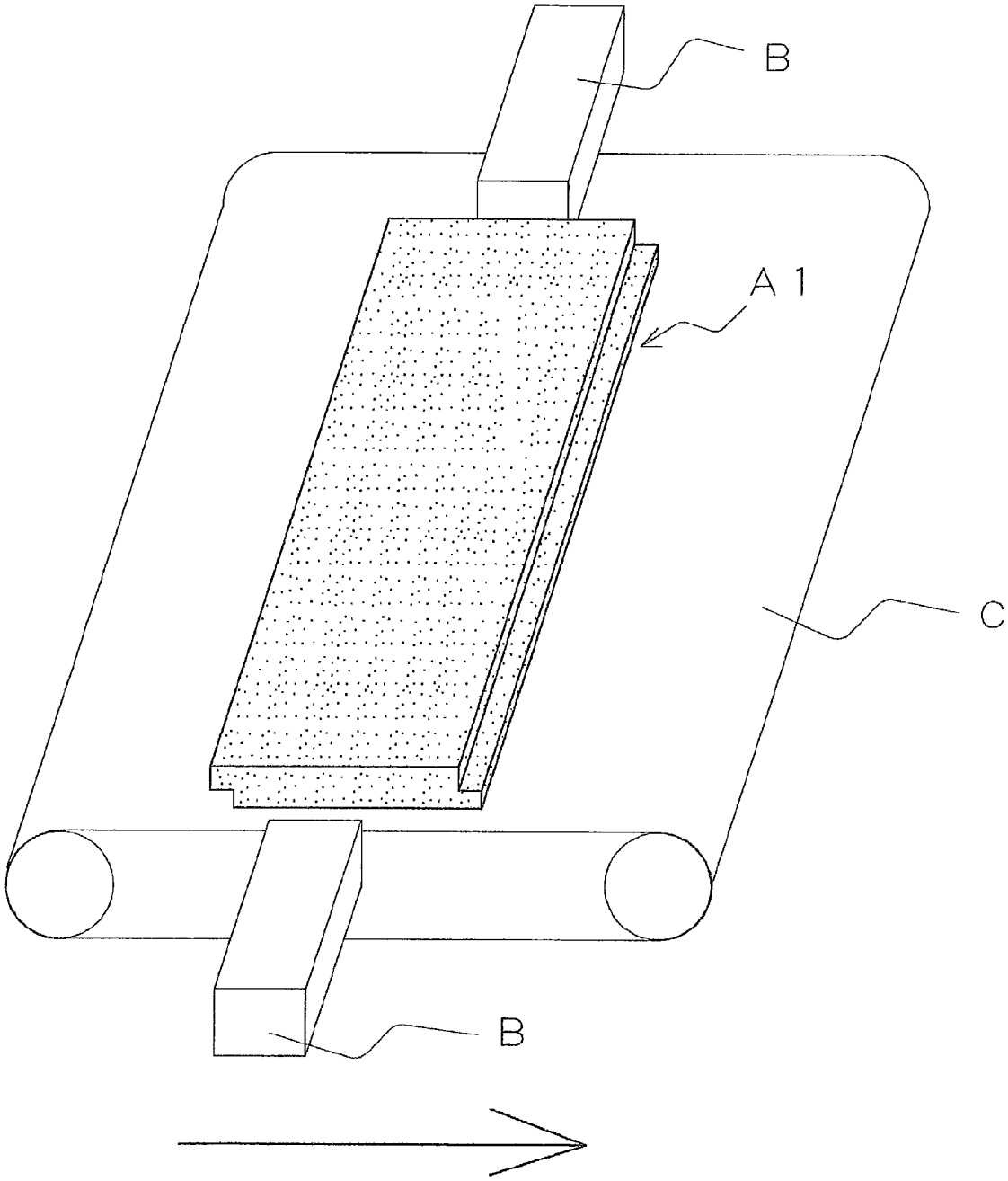
FIG. 2 is a schematic diagram showing equipment for performing laser irradiation on a side surface of the building board.

FIG. 2 is a schematic diagram showing equipment for performing laser irradiation on the side surface on either side of the building board. The equipment is arranged in a subsequent process to the process for coating the front surface of the building board.

By rotating a belt conveyor C, the building board A1 placed on the belt conveyor C is conveyed in the direction of an arrow. A laser light source B is arranged on the belt conveyor C to irradiate the side surface on either side of the conveyed building board A1 with a laser. The laser light source B is capable of moving vertically and horizontally, and therefore a laser irradiation range can be set freely such that the laser can be set to irradiate only the side surfaces of the building board A1. A limit switch may be arranged before the laser light source B such that when the building board A1 contacts the limit switch, the switch is turned on.

According to this equipment, after obtaining the building board A1 by coating the front surface of a building board, it is possible to subject only the side surface on either side of the building board A1 to laser irradiation while the building board A1 is conveyed, and therefore favorable productivity is achieved.

Figure 3:
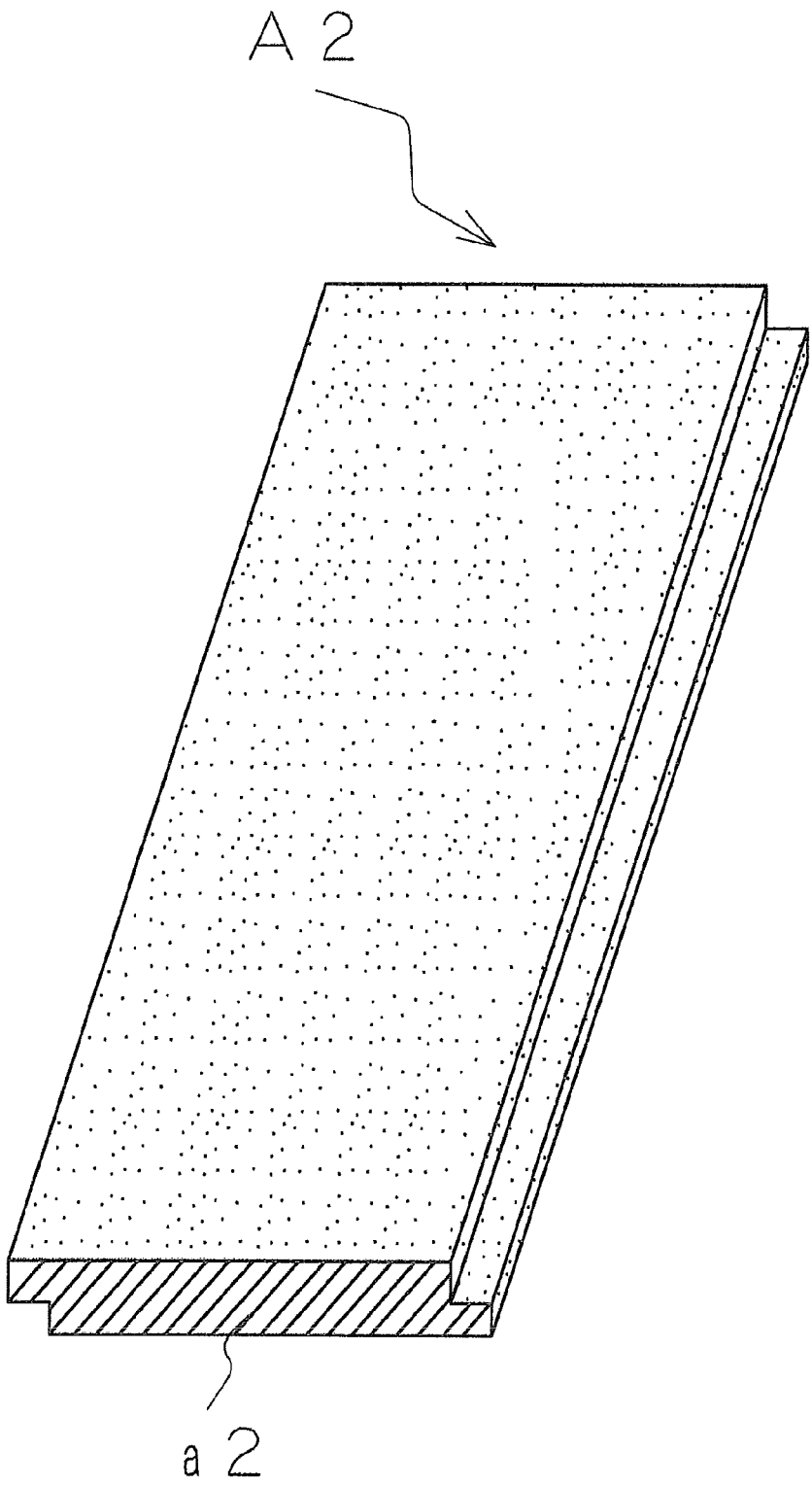
FIG. 3 is a view showing an example of a building board having a laser-irradiated side surface.

FIG. 3 is a view showing an example of a building board having a laser-irradiated side surface.

A building board A2 is manufactured by subjecting only the side surface on either side of the building board A1, which is obtained by coating the front surface of a building board, to laser irradiation using the equipment shown in FIG. 2. The laser irradiation range of the side surface extends over the entire side surface from the front surface side to the rear surface side.

The entire side surface on either side of the building board A2, from the front surface side to the rear surface side, is subjected to laser irradiation, and therefore the side surface of the building board A2 is formed from a laser-irradiated part a2 alone. The coating film on the laser-irradiated part a2 is removed by the laser such that the base material is exposed, and therefore the condition of the building board A2 is such that the coating film is removed from the entire side surface. In other words, the coating film is removed from the side surface of the building board A2 alone. Hence, when the building board A2 is installed, the outer appearance of the front surface is not damaged, and the sealing is less likely to peel away.

Figure 4:
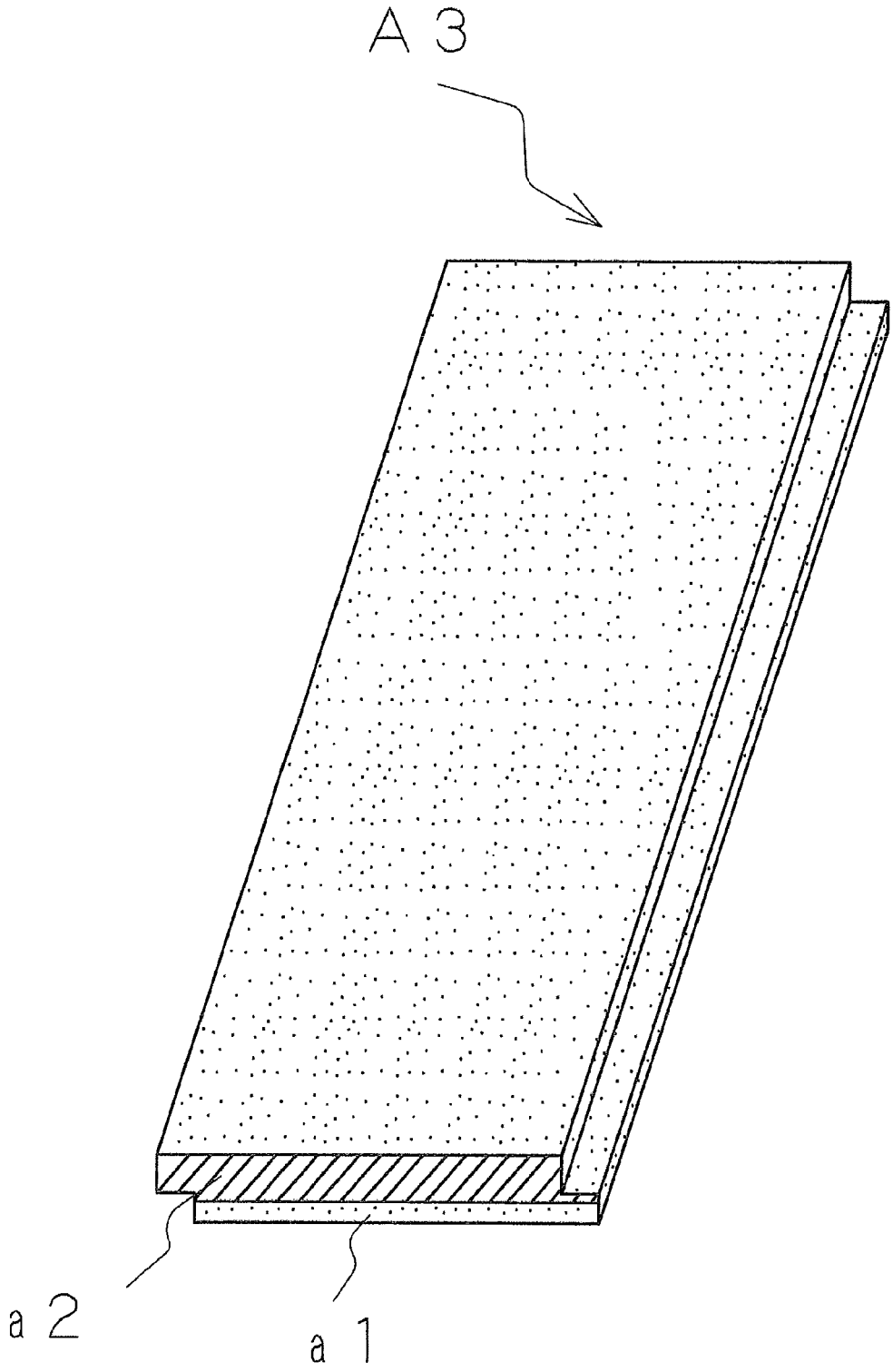
FIG. 4 is a view showing another example of a building board having a laser-irradiated side surface.

FIG. 4 is a view showing another example of a building board having a laser-irradiated side surface.

A building board A3 is manufactured by subjecting only the side surface on either side of the building board A1, which is obtained by coating the front surface of a building board, to laser irradiation using the equipment shown in FIG. 2. The laser irradiation range of the side surface extends over a constant width of the side surface from the front surface side to the rear surface side.

Laser irradiation is performed on the side surface on either side of the building board A3 from the front surface side toward the rear surface side at a width of 5 mm such that the side surface of the building board A3 includes a laser-irradiated part a2 and a coated part a1. In other words, the laser-irradiated part a2 is formed on the side surface on either side of the building board A3 at a width of 5 mm from the front surface side toward the rear surface side, and the remaining part is non-laser-irradiated coated part a1. The coating film is removed from the laser-irradiated part a2 by the laser such that the base material is exposed, and therefore the condition of the side surface of the building board A3 is such that the base material is made visible by removing the coating film at a width of 5 mm from the front surface side toward the rear surface side while the coating film remains on the remaining part.

When the building board A3 is installed, the sealing adhered to the laser-irradiated part a2 of the side surface on either side is unlikely to peel away, and since the range of this part is formed at a width of 5 mm from the front surface side toward the rear surface side, a sufficient overall adhesive force is obtained in the sealing, making the sealing less likely to peel away. Moreover, the front surface is not subjected to laser irradiation, and therefore the outer appearance of the front surface is not damaged.

Figure 5:
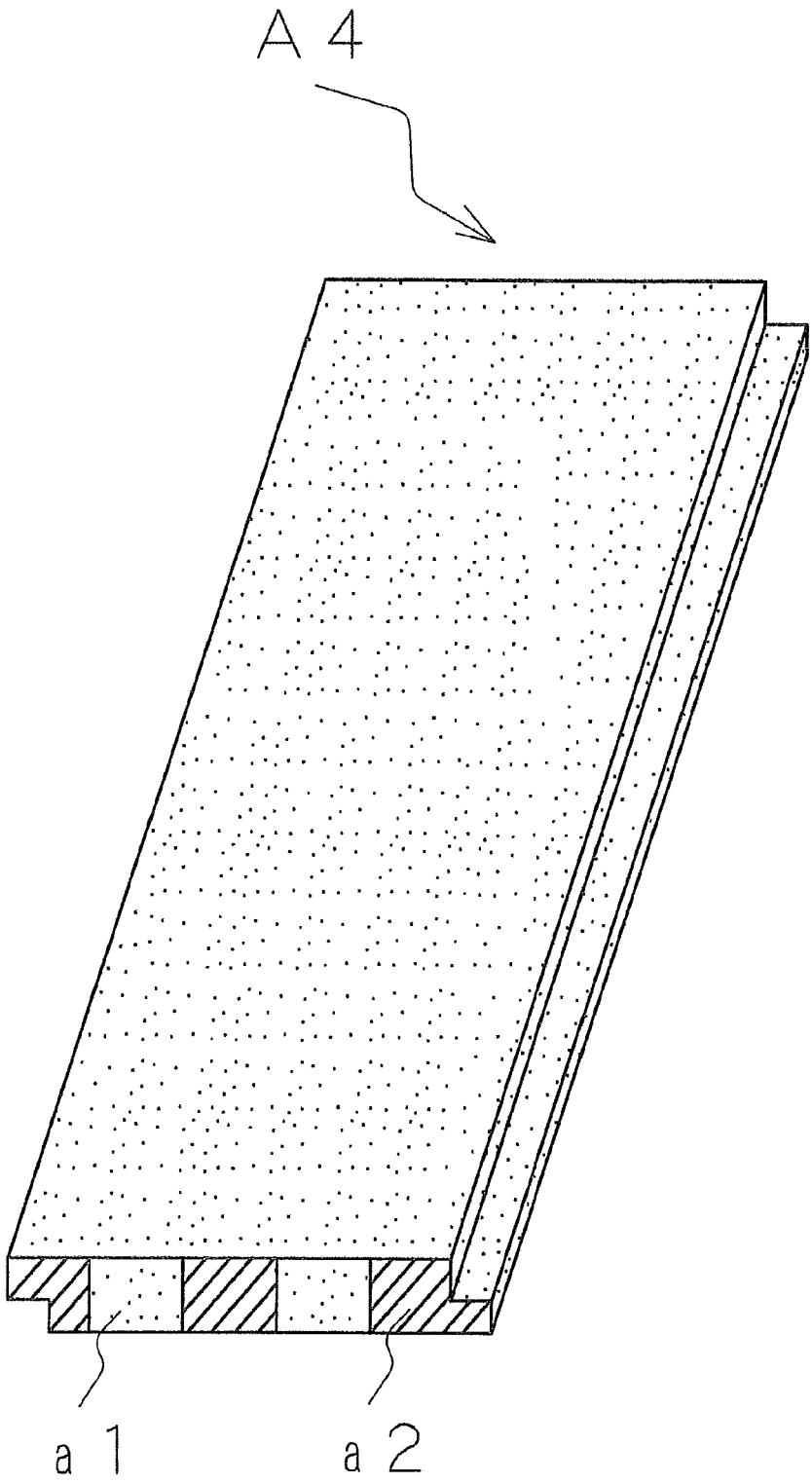
FIG. 5 is a view showing a further example of a building board having a laser-irradiated side surface.

FIG. 5 is a view showing a further example of a building board having a laser-irradiated side surface.

A building board A4 is manufactured by subjecting only the side surface on either side of the building board A1, which is obtained by coating the front surface of a building board, to laser irradiation using the equipment shown in FIG. 2. However, by operating and stopping the laser light source B repeatedly in short intervals which are shorter than time the building board A1 passes, laser-irradiated parts and non-laser-irradiated parts are provided on the side surface. Note that operating time of the laser light source is adjusted such that more laser-irradiated parts a2 are formed on the side surface of the building board A1 than non-laser-irradiated coated parts a1.

The side surface on either side of the building board A4 includes the laser-irradiated parts a2, which are formed by laser irradiation from the front surface side toward the rear surface side, and the coated parts a1, and more laser-irradiated parts a2 are provided than coated parts a1. In the laser-irradiated parts a2, the coating film is removed by the laser such that the base material is exposed. Hence, the side surface on either side of the building board A4 includes the laser-irradiated parts a2, in which the coating film is removed from the front surface side toward the rear surface side such that the base material is exposed, and the coated parts a1.

When the building board A4 is installed, the sealing adhered to the laser-irradiated parts a2 of the side surface on either side is not likely to peel away, and since more laser-irradiated parts a2 are formed than non-laser-irradiated coated parts a1, a sufficient overall adhesive force is obtained in the sealing, making the sealing less likely to peel away. Moreover, the front surface is not subjected to laser irradiation, and therefore the outer appearance of the front surface is not damaged.

Figure 6:
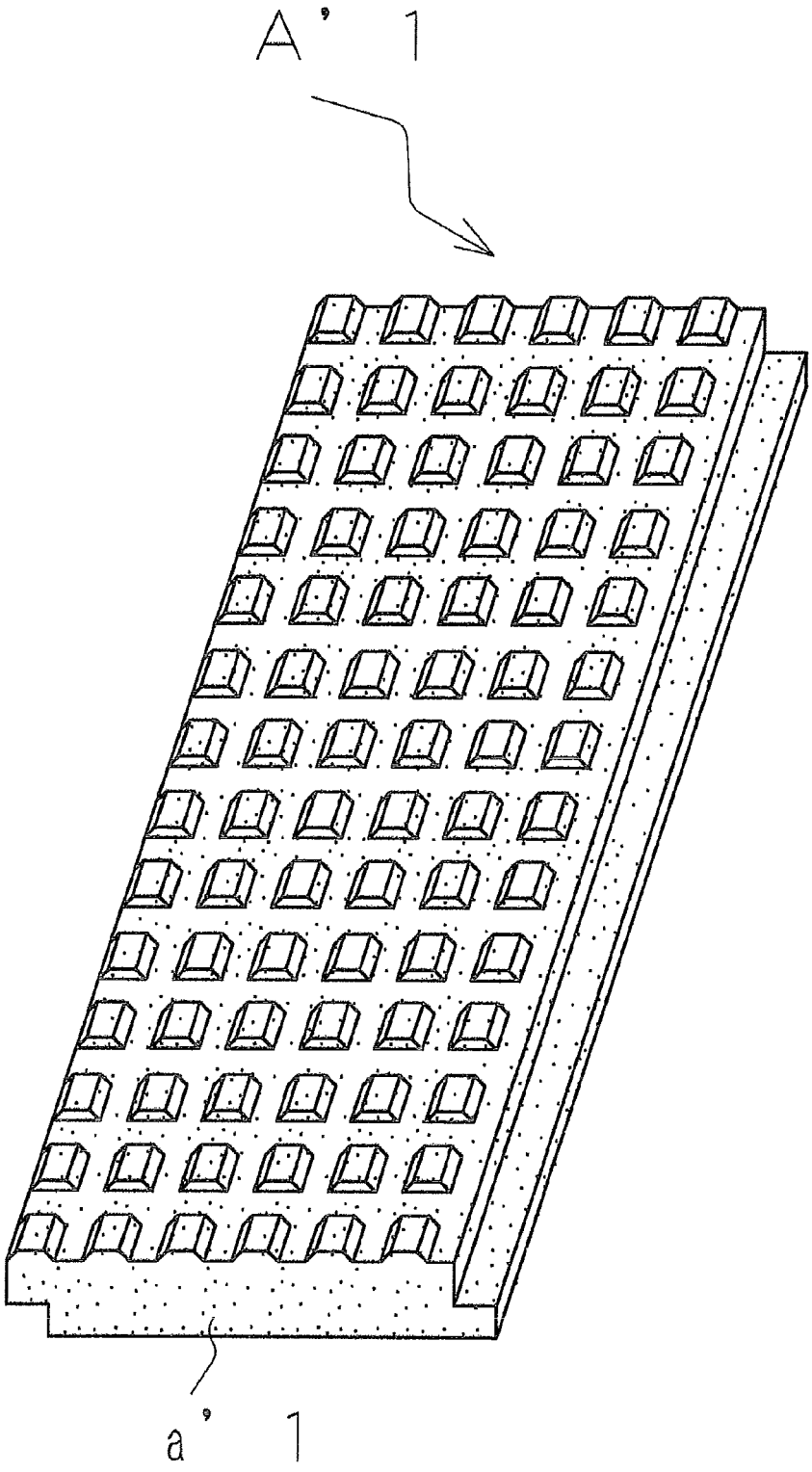
FIG. 6 is a view showing an example of a building board having design patent of convexoconcave on a front surface.

FIG. 6 is a view showing an example of a building board having design patent of convexoconcave on its front surface. A building board A'1 has a coated front surface and a side surface not having a shiplap portion, in which the front surface is coated in a process for applying coat to the front surface using spray, a flow coater, a roll coater, or similar. The coat spreads over the side surface to form a coated part a'1. Although not shown in the drawing, a far-side side surface also does not include a shiplap portion and the coat spreads over this side surface also to form a coated part a'1.

Figure 7:
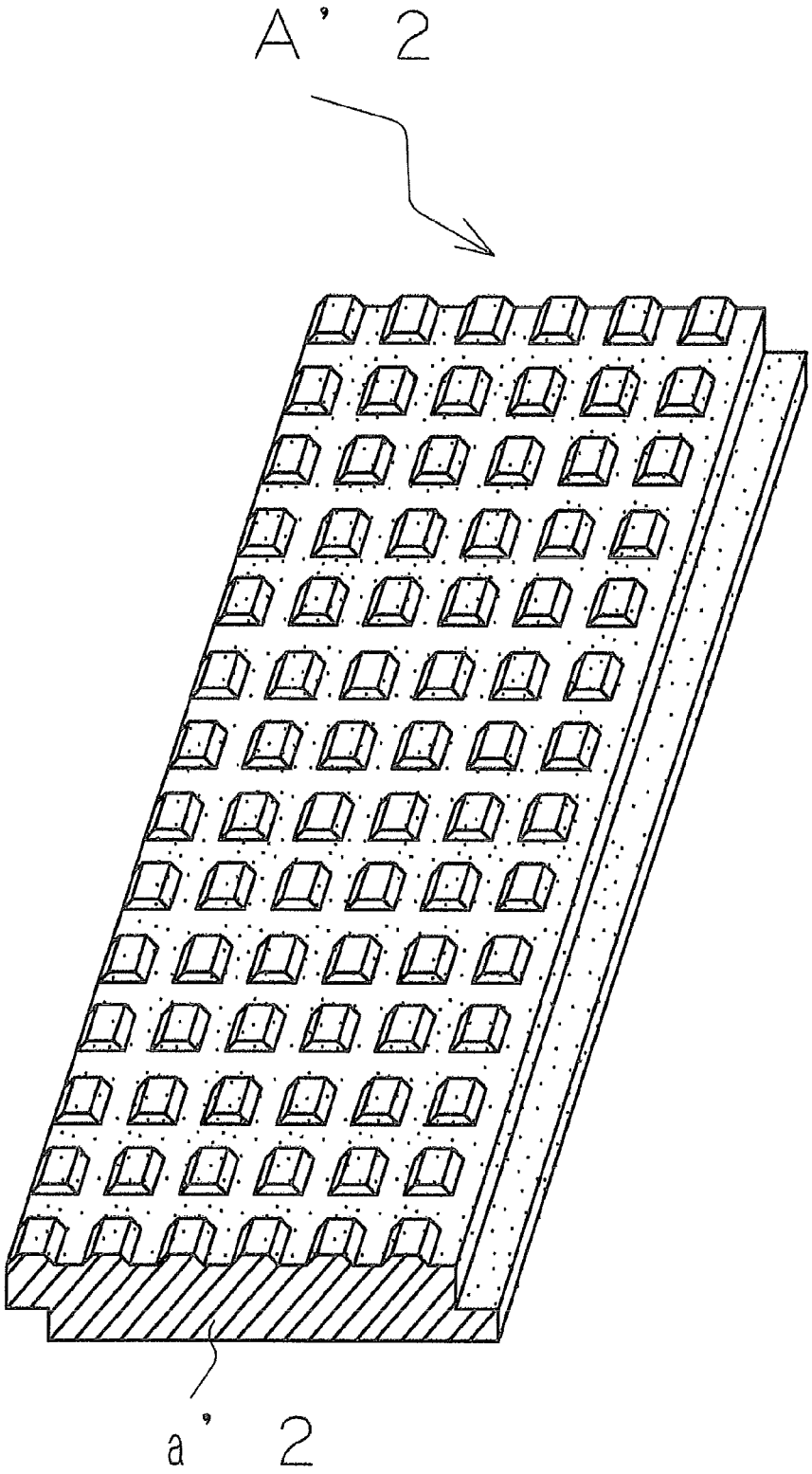
FIG. 7 is a view showing an example in which a side surface of the building board having design patent of convexoconcave on the front surface is subjected to laser irradiation.

FIG. 7 is a view showing an example in which the side surface of a building board having design patent of convexo-concave on the front surface is subjected to laser irradiation.

A building board A'2 is manufactured by subjecting only the side surface on either side of the building board A'1, which is obtained by coating the front surface of a building board, to laser irradiation using the equipment shown in FIG. 2. The laser irradiation range of the side surface extends over the entire side surface from the front surface side to the rear surface side.

The entire side surface on either side of the building board A'2 is subjected to laser irradiation from the apex of a convex portion to the rear surface side, and therefore the side surface on either side of the building board A'2 is formed from a laser-irradiated part a'2 alone. The coating film on the laser-irradiated part a'2 is removed by the laser such that the base material is exposed, and therefore the coating film is removed from the entire side surface on either side of the building board A'2. In other words, the condition of the building board A'2 is such that the coating film is removed from the side surface alone. Hence, when the building board A'2 is installed, the outer appearance of the front surface is not damaged, and the sealing is less likely to peel away.

Figure 8:
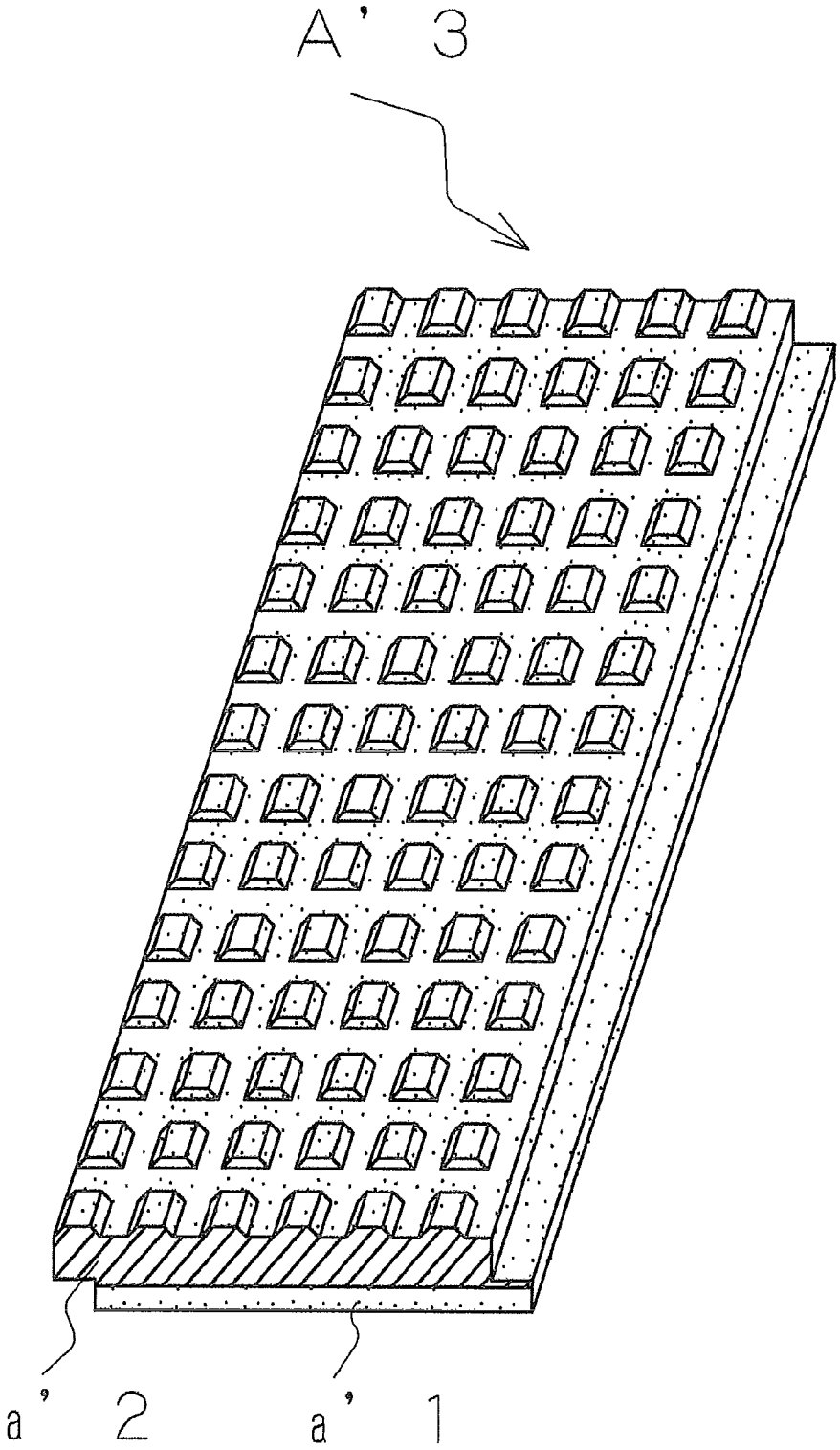
FIG. 8 is a view showing another example in which the side surface of the building board having design patent of convexoconcave on the front surface is subjected to laser irradiation.

FIG. 8 is a view showing another example in which the side surface of a building board having design patent of convexo-concave on the front surface is subjected to laser irradiation.

A building board A'3 is manufactured by subjecting only the side surface on either side of the building board A'1, which is obtained by coating the front surface of a building board, to laser irradiation using the equipment shown in FIG. 2. The laser irradiation range of the side surface extends over a constant width of the side surface from the front surface side toward the rear surface side.

Laser irradiation is performed on the side surface on either side of the building board A'3 at a width from the apex of the convex portion to the lowest side of a concave portion and a width of 5 mm from the lowest side of the concave portion to the rear surface side such that the side surface of the building board A'3 includes a laser-irradiated part a'2 and a coated part a'1. In other words, the laser-irradiated part a'2 is formed on the side surface on either side of the building board A'3 at a width from the apex of the convex portion to the lowest side of a concave portion and a width of 5 mm from the lowest side of the concave portion to the rear surface side, and the remaining part is the non-laser-irradiated coated part a'1. The coating film is removed from the laser-irradiated part a'2 by the laser such that the base material is exposed, and therefore the condition of the side surface on either side of the building board A'3 is such that the base material is made visible by removing the coating film at a width from the apex of the convex portion to the lowest side of a concave portion and a width of 5 mm from the lowest side of the concave portion to the rear surface side while the coating film remains on the remaining part.

When the building board A'3 is installed, the sealing adhered to the laser-irradiated part a'2 is unlikely to peel away, and since the range of this part is formed at a width from the apex of the convex portion to the lowest side of a concave portion and a width of 5 mm from the lowest side of the concave portion to the rear surface side, a sufficient overall adhesive force is obtained in the sealing, making the sealing less likely to peel away. Moreover, the front surface is not subjected to laser irradiation, and therefore the outer appearance of the front surface is not damaged.

Figure 9:
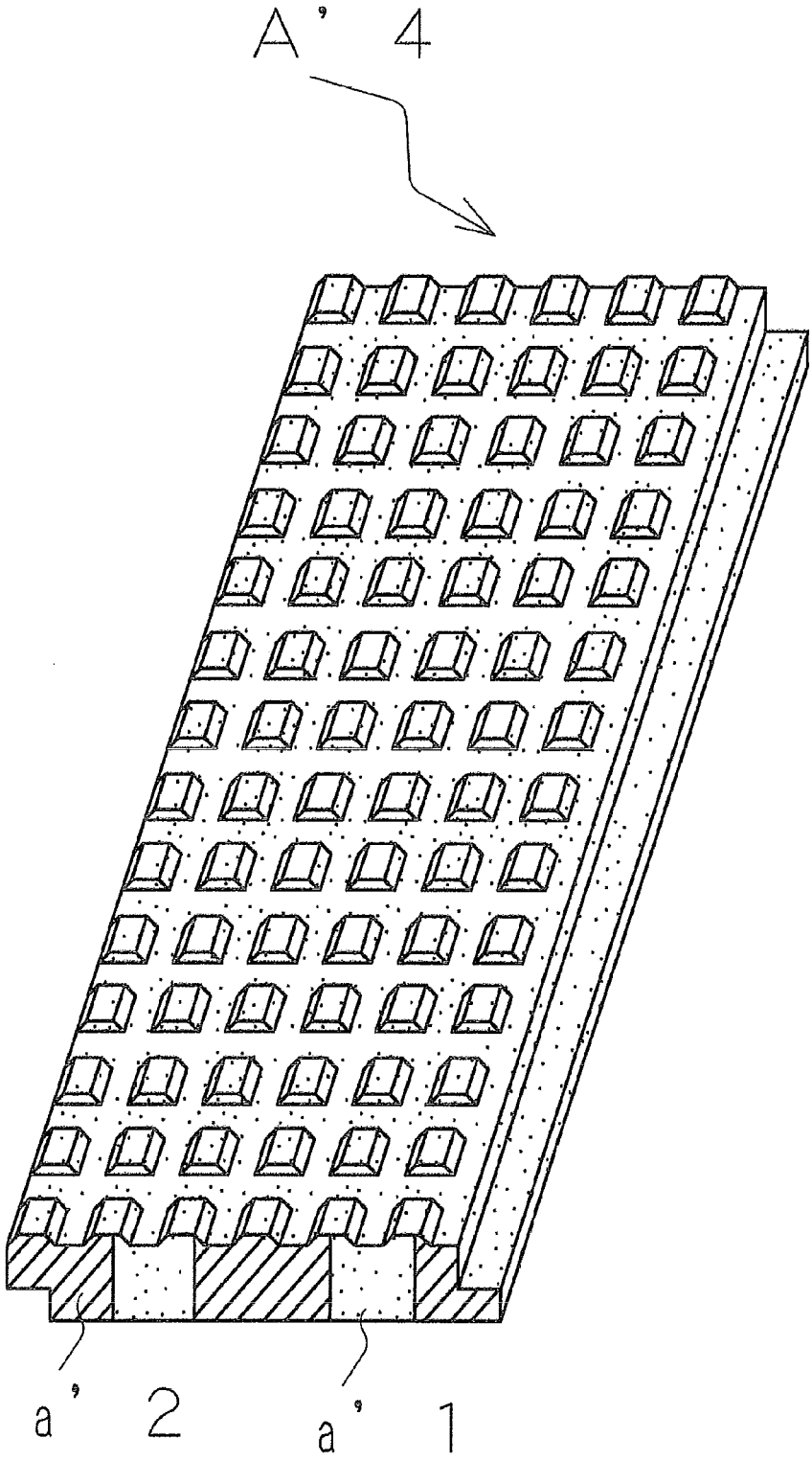
FIG. 9 is a view showing a further example in which the side surface of the building board having design patent of convexoconcave on the front surface is subjected to laser irradiation.

FIG. 9 is a view showing a further example in which the side surface of a building board having design patent of convexoconcave on the front surface is subjected to laser irradiation.

A building board A'4 is manufactured by subjecting only the side surface on either side of the building board A'1, which is obtained by coating the front surface of a building board, to laser irradiation using the equipment shown in FIG. 2. However, by operating and stopping the laser light source B repeatedly in short intervals which is shorter than time the building board A'1 passes, laser-irradiated parts and non-laser-irradiated parts are provided on the side surface. Note that operating time of the laser light source is adjusted such that more laser-irradiated parts a'2 are formed on the side surface of the building board A'1 than non-laser-irradiated coated parts a'1.

The side surface on either side of the building board A'4 includes the laser-irradiated parts a'2, which are formed by laser irradiation from the front surface side toward the rear surface side, and the coated parts a'1, and more laser-irradiated parts a'2 are provided than coated parts a'1. In the laser-irradiated parts a'2, the coating film is removed by the laser such that the base material is exposed. Hence, the side surface on either side of the building board A'4 includes the laser-irradiated parts a'2, in which the coating film is removed from the front surface side toward the rear surface side such that the base material is exposed, and the coated parts a'1.

When the building board A'4 is installed, the sealing adhered to the laser-irradiated parts a'2 is not likely to peel away, and since more laser-irradiated parts a'2 are formed than coated parts a'1, a sufficient overall adhesive force is obtained in the sealing, making the sealing less likely to peel away. Moreover, the front surface is not subjected to laser irradiation, and therefore the outer appearance of the front surface is not damaged.

An embodiment of the present invention was described above, but the present invention is not limited to this embodiment, and various modified embodiments may be obtained within the scope of the claims. Further, laser irradiation onto the side surface of the building material may be performed on one side surface, and in a building material not having a shiplap portion, laser irradiation may be performed on all three or four side surfaces.

As described above, according to the present invention, only the coating film formed on the side surface of the building material is removed or reduced by laser irradiation, and therefore a building material in which a sealing is unlikely to peel away during installing can be provided without damaging the design characteristic of the front surface. Furthermore, a building material having design patent of convexo-concave on its front surface, in which a sealing is unlikely to peel away during installing, can be provided.

What is claimed is:

1. A building material comprising:

a building board having a front surface, a rear surface, a top surface having a shiplap portion, a bottom surface having lap portion, and side surfaces, the side surfaces each vertically extending from the front surface to the rear surface and having no shiplap portion;

a coating film formed on the front surface; and a coating film formed on the side surface, wherein the side surface is irradiated by a laser so that an upper portion of the side surface of the building hoard adjacent to the front surface is exposed in a longitudinal direction of the building board from the top surface to the bottom surface, the coating film on the side surface is located at a lower portion of the side surface adjacent to the rear surface and extends in the longitudinal direction of the building board from the top surface to the bottom surface, and a sealing material optionally disposed directly on the exposed portion of the side surface of the building board, the exposed portion of the side surface extends along a corner between the side surface and the front surface in the longitudinal direction of the building hoard from the top surface to the bottom surface and has at least 5 mm of width in the thickness direction from the front surface to the rear surface.

2. The budding material according to claim 1, wherein the building board has a convexo-concave surface on the front surface, the upper portion of the side surface has a convexo-concave shape along with the convexo-concave surface of the front surface, and the upper portion of the side surface adjacent to the front surface is irradiated by the laser, so that the building hoard is exposed at the side surface of a convex portion and the side surface of at least 5 mm width from the bottom of a concave portion in the thickness direction and a sealing material can be disposed directly on the exposed portion of the side surface of the building board.

3. The building material according to claim 1, wherein the width in the thickness direction of the exposed portion of the side surface is wider than a width in the thickness direction of the coated portion of the side surface.

4. The building material according to claim 1, wherein the sealing material is directly disposed on the exposed portion of the side surface of the building board.

5. A building material comprising:

a building board having a front surface, a rear surface, a top surface having a shiplap portion, a bottom surface having a shiplap portion, and side surfaces the side surfaces each vertically extending from the front surface to the rear surface and having no shiplap portion;

a coating film formed on the front surface;

a coating film formed on the side surface, wherein the side surface is irradiated by a laser so that the side surface of the building board is exposed, the exposed portion of the building board extends in a thickness direction of the building board from the front surface to the rear surface, the exposed portion and a coated portion of the side surface are disposed alternately on the side surface, and a sealing material optionally disposed directly on the exposed portion of the site surface of the building board.

6. The building material according to claim 5, wherein the building material has a convexo-concave surface on the front surface, and an upper portion of the side surface has a convexo-concave shape along with the convexo-concave surface of the front surface.

7. The building material according to claim 5, wherein the sealing material is directly disposed on the exposed portion of the side surface of the building board.

* * * * *